United States Patent [19]

Kubo et al.

[11] Patent Number: 4,895,105

[45] Date of Patent: Jan. 23, 1990

[54] DEVELOPING APPARATUS WITH PRESSURE REGULATING MEMBER

[75] Inventors: Takahiro Kubo, Tokyo; Hatsuo Tajima, Matsudo, both of Japan

[73] Assignee: Canon Kabushiki Kaisha, Tokyo, Japan

[21] Appl. No.: 253,080

[22] Filed: Oct. 4, 1988

[30] Foreign Application Priority Data

Oct. 7, 1987 [JP] Japan ..... 62-251632

[51] Int. Cl.[4] ..... G03G 15/09

[52] U.S. Cl. ..... 118/658; 355/251

[58] Field of Search ..... 118/657, 658; 355/14 D, 355/3 DD

[56] References Cited

U.S. PATENT DOCUMENTS 4,406,535 9/1983 Sakamoto et al. ..... 118/658 X
4,458,627 7/1984 Hosono et al. ..... 118/658 X
4,511,239 4/1985 Kanbe et al. ..... 118/658 X
4,674,439 6/1987 Sakamoto et al. ..... 118/658 X
4,814,818 3/1989 Fuma et al. ..... 355/14 D X

*Primary Examiner*—Fred L. Braun
*Assistant Examiner*—Robert Beatty
*Attorney, Agent, or Firm*—Fitzpatrick, Cella, Harper & Scinto

[57] ABSTRACT

A magnet is disposed in a sleeve for carrying a developer. At a position between two adjacent magnetic poles along the periphery of the magnet, an elastic plate is contacted to the sleeve. The elastic plate is effective to regulate a thickness of a layer of the developer applied on the carrying member. Of the magnetic poles, the magnetic pole disposed upstream of a contact position between the elastic plate and the sleeve with respect to the rotational direction of the sleeve provides a magnetic force F (Gauss). The elastic plate is contacted to the sleeve with the pressure P (g/cm). In this structure, $0.71P+385 \leqq F \leqq -1.43P+1630$ is satisfied.

12 Claims, 4 Drawing Sheets

DEVELOPING APPARATUS WITH PRESSURE REGULATING MEMBER

FIELD OF THE INVENTION AND RELATED ART

The present invention relates to a developing apparatus for developing an electrostatic latent image.

A developing apparatus is known wherein a stationary magnetic field generating means is disposed in a rotatable cylindrical developer carrying member made of a non-magnetic material, and wherein a developer is conveyed toward a developing zone, while being retained on the developer carrying member by the magnetic force by the magnetic field generating means, and is regulated to a layer having a predetermined thickness by contact pressure by a regulating member such as a thin rubber plate or the like, and thereafter, is supplied to a latent image bearing member to develop the latent image (U.S. Pat. Nos. 4,458,627, 4,356,245, 4,391,891, 4,377,332).

In this type of the developing apparatus, the image quality of the developed image tends to be dependent on the contact pressure of the regulating member to the developer carrying member. More particularly, if the contact pressure is too high, the developer (toner) is not sufficiently applied to the developer carrying member with the result of non-uniform image density or insufficient image density of a solid black image. If the contact pressure is too low, the toner is not sufficiently electrically charged, and the thickness of the applied developer becomes too large on the developer carrying member with the result of ghost image or foggy background.

U.S. Pat. No. 4,579,081 discloses a means for adjusting the contact pressure of the regulating member to the developer carrying member. However, when a magnetic pole is provided to convey the developer toward the regulating zone, the magnetic force thereof is influential to the formation of the developer layer. This U.S. Patent does not deal with the magnetic force provided by such a conveying magnetic pole.

SUMMARY OF THE INVENTION

Accordingly, it is a principal object of the present invention to provide a developing apparatus wherein a thickness of the developer layer is regulated by an elastic regulating member, and wherein a desirable developer layer can be formed.

It is another object of the present invention to provide such a developing apparatus in which a proper thickness of the developer layer can be provided.

It is a further object of the present invention to provide a developing apparatus in which the developer can be properly triboelectrically charged.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
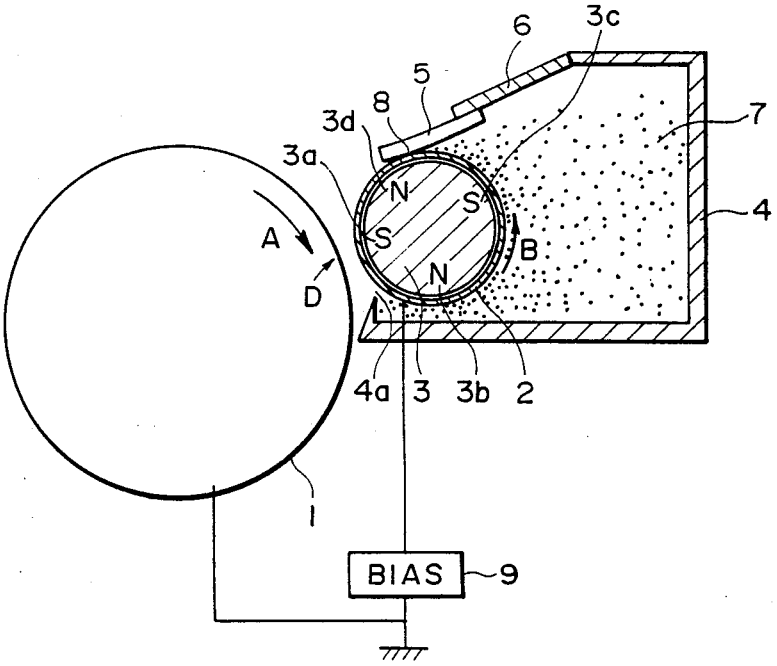
FIG. 1 is a sectional view of a developing apparatus according to an embodiment of the present invention.

Referring to FIG. 1, there is shown a developing apparatus according to an embodiment of the present invention, wherein reference numeral 1 designates an electrophotographic photosensitive drum rotatable in a direction indicated by an arrow A. The drum 1 has a surface layer made of an electrophotographic photosensitive material such as OPC (organic photoconductor). An electrostatic latent image is formed on the drum 1 through a well-known Carlson process. The latent image thus formed is developed at the developing zone D. Around the drum 1, there are disposed charging means, exposure means, image transfer means and cleaning means and others, which however, may be of one of well-known type, and therefore, detailed description thereof is omitted for simplicity.

The developing device includes a developer container 4 for containing one component magnetic developer (magnetic toner) 7, the container 4 being provided with an opening 4*a* in its front wall. The developing device further comprises a rotatable developing sleeve (developer carrying member) 2 made of non-magnetic material disposed in the opening 4*a* with a part thereof projected out of the developer container 4 so as to be opposed to the photosensitive drum 1 with a clearance in a developing zone D, and a regulating member 5 made of a non-magnetic elastic thin plate such as urethane rubber and resiliently contacted to the developing sleeve 2 at a contact portion 8. In the developing sleeve 2 there is a stationary magnet roll 3 having four magnetic poles (magnetic field generating means) 3*a*, 3*b*, 3*c* and 3*d* adjacent its outer periphery. In the embodiment of FIG. 1, the number of the magnetic poles of the magnet roll 3 is four, but it may be two or more.

The regulating member 5 is fixed to the container by a holder 6. The material of the regulating member 5 may be nitrile rubber, fluorine rubber, silicone rubber, ethylene propyrene rubber or the like as well as the above-described urethane rubber. In any case, the regulating member 5 is preferably made of such a material that when it is contacted to the toner, the toner is charged to a polarity for developing the latent image.

The developing sleeve 2 rotates in a direction indicated by an arrow B (counterclockwise), whereas the magnetic force by the magnet roll 3 attracts the developer on the surface of the developing sleeve 2. By those functions, the developer is conveyed out of the developer container, more particularly, to the developing zone D. In this embodiment, a predetermined clearance is formed between the developing sleeve and the photosensitive drum. However, the present invention is applicable to the case where they are contacted, as when an elastic developing sleeve is used.

A developing bias source 9 is connected to the developing sleeve 2. The bias source 9 is effective to form an alternating electric field superimposed with a DC component between the developing sleeve 2 and at least the image area of the latent image bearing member in the developing zone D, by which the developer is vibrated to deposit the developer to the image area of the electrostatic latent image formed on the drum 1.

Next, the magnet roll 3 has four magnetic poles 3*a*, 3*b*, 3*c* and 3*d* adjacent its periphery, as described hereinbefore. The magnetic pole 3*a* (S-pole) is disposed in opposition to the developing zone D as a developing electrode for forming a magnetic field contributable to prevention of the foggy background. The magnetic poles 3*a*, 3*b*, 3*c* and 3*d* are disposed in the order named along the rotational direction of the developing sleeve. The magnetic pole 3*c* forms a magnetic field for magnetically attracting the developer 7 in the container 4 onto the sleeve 2 and for conveying the developer to the developer layer regulating position including the elastic regulating member 5. The magnetic field formed by the magnetic pole 3*c* extends to a contact portion 8 between the elastic regulating member. 5 and the sleeve 2. The magnetic pole 3*b* contributes to formation of a magnetic field for conveying the developer having passed through the developing zone D into the container 4. The magnetic pole 3*d* contributes to formation of the magnetic field for conveying into the developing zone D the developer layer having been regulated in its thickness by the elastic regulating member 5. In the embodiment of FIG. 1, the magnetic poles 3*a* and 3*c* are on a diameter of the magnet roll 3, but this is not inevitable: The magnetic pole 3*c* is to be disposed opposed to the inside of the container.

Each of the magnetic poles may be in the form of a permanent magnet or an electromagnet.

As described, in the apparatus of FIG. 1, the developer 7 in the developer container 4 is retained on the surface of the developing sleeve 2 by the magnetic force provided by the magnetic pole 3*c* of the magnet roll 3. With the rotation of the developing sleeve 2, the developer is conveyed to a zone wherein the regulating member 5 and the developing sleeve 2 are contacted. At the contact portion 8, the amount of the developer conveyed (the applied thickness) is regulated, and simultaneously, due to the friction between the developer and the sleeve 2 and the friction between the member 5 and the developer, the developer is triboelectrically charged to such an extent as to be sufficient for development. Further, the developer is conveyed, while being retained on the surface of the developing sleeve by the magnetic force of the magnetic pole 3*d*, to the developing zone D, by the rotation of the sleeve 2. In the developing zone D, the developing sleeve 2 is disposed opposed to the photosensitive drum 1, where B the latent image is developed. The developer 7 used for the developing action is conveyed, while being retained on the surface of the sleeve 2 by the magnetic force of the magnetic pole 3*b*, by the rotation of the developing sleeve 2, and is collected back into the developer container 4.

Figure 2:
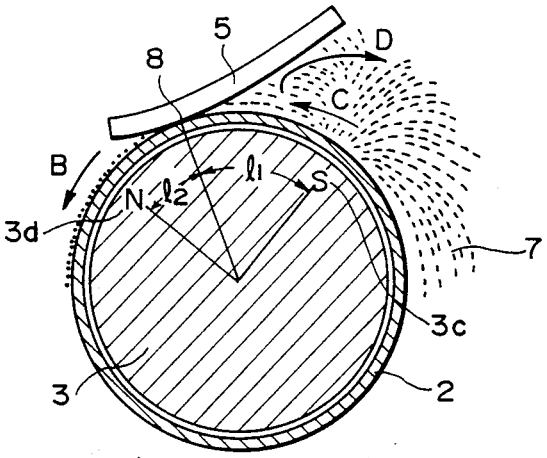
FIG. 2 is an enlarged sectional view of a part of the developing apparatus shown in FIG. 1.

FIG. 2 is an enlarged view adjacent the contact portion 8 in FIG. 1 to illustrate the behavior of the developer 7.

As will be understood from FIG. 2, the elastic regulating member 5 is contacted to the sleeve 2 at a position between the two adjacent magnetic poles 3*c* and 3*d*. In other words, the maximum magnetic flux density position on the sleeve surface of the magnetic pole 3*c* is upstream of the contact portion 8 with respect to the rotational direction of the sleeve 2. The maximum magnetic flux density position of the magnetic pole 3*d* on the sleeve surface is downstream of the contact portion 8 with respect to the rotational direction of the sleeve 2.

In FIG. 2, the developer 7 is conveyed, while being retained on the surface of the developing sleeve 2 by the magnetic force of the magnetic pole 3*c*, to the contact portion in the direction indicated by an arrow C by the rotation of the developing sleeve 2 indicated by an arrow B. In the contact portion 8, the pressure is applied by the elasticity of the regulating member 5, and therefore, a part of the developer is returned in the direction D. The rest of the developer is passed through the contact portion 8 to be used for the developing action, while being retained on the surface of the developing sleeve 2 by the magnetic force of the magnetic pole 3*d*, and then conveyed to the developing portion by the rotation of the developing sleeve 2.

The developer passing through the contact portion 8 is supplied with the triboelectric charge necessary and sufficient for the development by the pressure in the contact portion 8. The charge applying power increases with increase of the pressure, as is known. Also, it is known that the amount of the developer on the sleeve decreases with the increase of the pressure.

The amount of the developer on the developing sleeve 2, and therefore, the thickness thereof increases with increase of the magnetic force of the magnetic pole 3*c*. If the magnetic force is less than 400 Gausses, the amount of the developer retained on the surface of the developing sleeve is too small, so that when a solid black image is copied, a sufficient image density can not be provided, which has been empirically confirmed.

Figure 3:
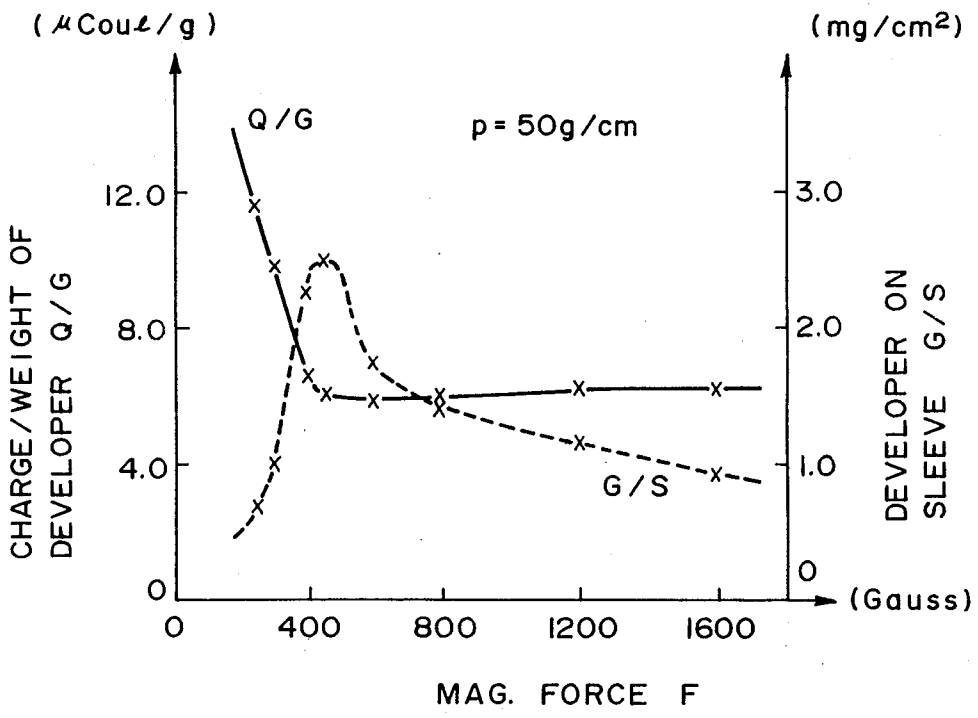
FIG. 3 is a graph showing a relation between an amount of triboelectric charge of the developer or an amount of the applied developer with respect to a magnetic force.

FIG. 3 is a graph illustrating an amount of triboelectric charge per unit weight of the developer in Q/G ($\mu$Coul/g) of the developer or the amount of the developer applied per area squared on the developing sleeve 2 in G/S (mg/cm$^2$) and the magnetic force F (Gauss) of the magnetic pole 3*c* when the contact pressure P of the elastic member 5 to the sleeve 2 is maintained constant at 50 g/cm (the weight of contact per 1 cm measured along the length of the sleeve, that is, parallel to the axis of the sleeve). As will be understood from FIG. 3, when the magnetic force F is more than 400 Gausses, the amount of charge Q/G does not change significantly, but the amount of the developer G/S on the developing sleeve decreases with increase of the magnetic force F.

Therefore, it has been found that a sufficient density of a solid black image can not be provided unless the contact pressure P is decreased, when the magnetic force F is very strong.

Figure 4:
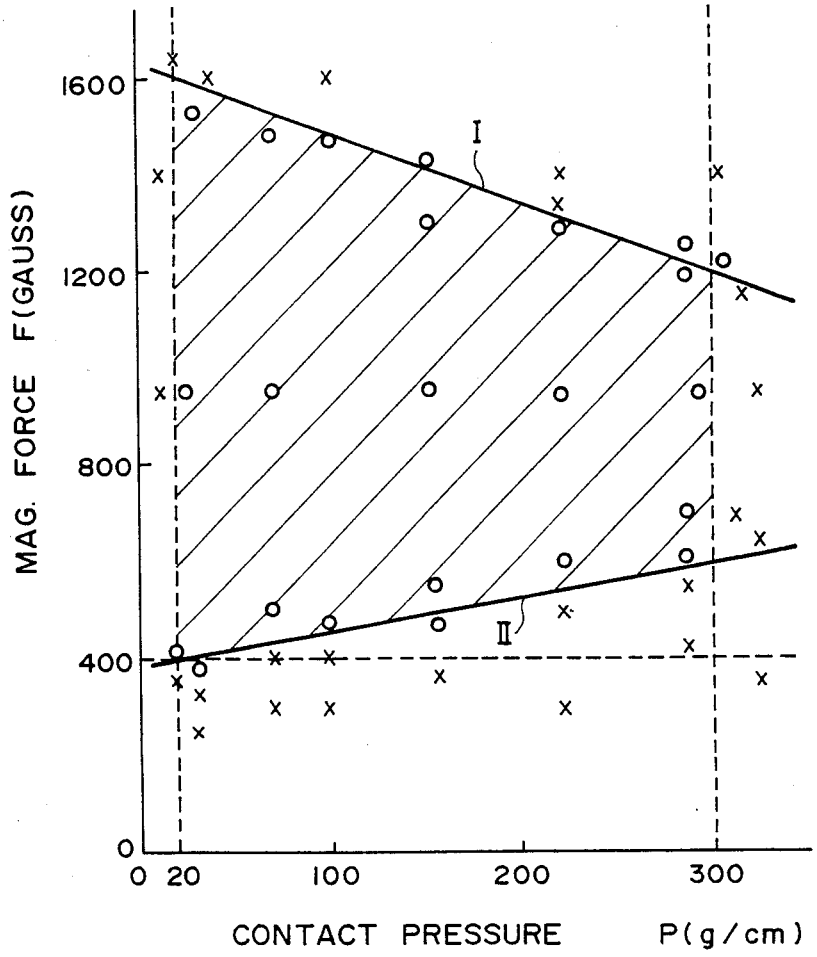
FIG. 4 is a graph showing a region of the contact pressure and the magnetic force to provide good image formation.

FIG. 4 is a graph showing a region wherein a stabilized developer application onto the developing sleeve and a stabilized triboelectric charge can be provided, in relation to the above-described magnetic force F and contact pressure P. The upper limit can be approximated by a linear line I representing $F = -1.43\ P + 1630$ whereas the lower limit is approximated by a linear line II representing $F = 0.71P + 385$. Above the line I, the amount of the applied developer is too small with the result of non-uniform or insufficient density images. Below the line II, the sufficient triboelectric charge can not be applied stably to the developer with the result that a ghost image is produced which is an image of a previous developed image appears on the current image. Another disadvantageous result is the production of the foggy background. In the Figure, "o"

indicates that the image is good, whereas "x" indicates no good results.

Even within the region between the line I and the line II, if the contact pressure P is smaller than 20 (g/cm), it has been found that the triboelectric charge of the developer becomes insufficient with the result of the ghost image or foggy background as in the region below the line II.

Further, even within the range between the line I and the line II, if the contact pressure P is larger than 300 (g/cm), the amount of the developer applied on the developing sleeve becomes insufficient resulting in non-uniform images and insufficient image density, as in the region above the line I.

In the experiments and investigations described above, it has been found that by placing the parameters in the region hatched in FIG. 4, the developer can be stably applied on the developing sleeve and can be sufficiently and stably triboelectrically charged, leading to formation of good quality images.

The description will be made as to the significance of a distance $l_1$ between the magnetic pole 3*c* and the contact portion 8 measured along the outer periphery of the sleeve 2 and a distance $l_2$ measured on the outer surface of the sleeve between the contact portion 8 and the magnetic pole 3*d*. Here, the distances are measured on the basis of the maximum magnetic flux density positions. When the magnetic pole 3*d* is right below the contact portion, the developer tends to magnetically erect in the contact portion 8 with the result of unstable developer layer. Therefore, the distance $l_2$ is preferably not less than 5 mm.

Even if the magnetic pole 3*c* is right below the contact portion 8, the stabilized developer layer can not be provided for the same reasons described above. However, the developer is packed at a position upstream of the contact portion 8, the magnetic pole 3*c* may be closer to the contact portion 8 than the magnetic pole 3*d*. The distance $l_1$ is preferably not less than 2 mm.

If the magnetic poles 3*c* and 3*d* are too distant from the contact portion 8, the introduction of the developer into the space formed between the sleeve 2 and the regulating member 5 becomes insufficient, and therefore, sum $(l_1+l_2)$ of the distances $l_1$ and $l_2$ is preferably not more than 20 mm.

If the magnetic force of the magnetic pole 3*d* is less than 400 Gausses, the conveying force to the developer decreases too much, resulting in the conveyance of the developer into the space becoming not sufficient, whereby the thickness of the developer layer becomes too small. If the magnetic force of the magnetic pole 3*d* is larger than 1200 Gausses, the conveying force to the developer is too strong, so that a larger amount of such a developer is not sufficiently triboelectrically charged and is conveyed out of the contact portion 8. Therefore, the magnetic force by the magnetic pole 3*d* is preferably not less than 400 Gausses and not more than 1200 Gausses.

In this specification, the magnetic force by the magnetic pole means that the maximum magnetic flux density of the magnetic pole on the sleeve surface.

Figure 5:
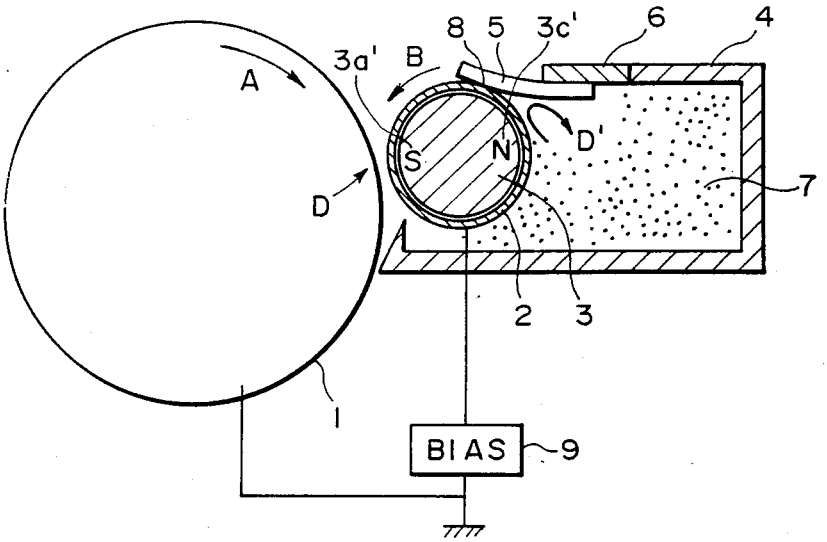
FIG. 5 is a sectional view of a developing apparatus according to another embodiment of the present invention.

FIG. 5 illustrates another embodiment of the present invention, which is characterized in that the magnet roll has only two magnetic poles 3*a*'and 3*c*' adjacent the periphery thereof. In the shown example, the magnetic poles 3*a*' and 3*c*' are on a diameter of the magnet roll 3, but this is not limiting. A developing apparatus using a magnet roll having two magnetic poles is disclosed in U.S. Ser. No. 210,250.

Figure 6:
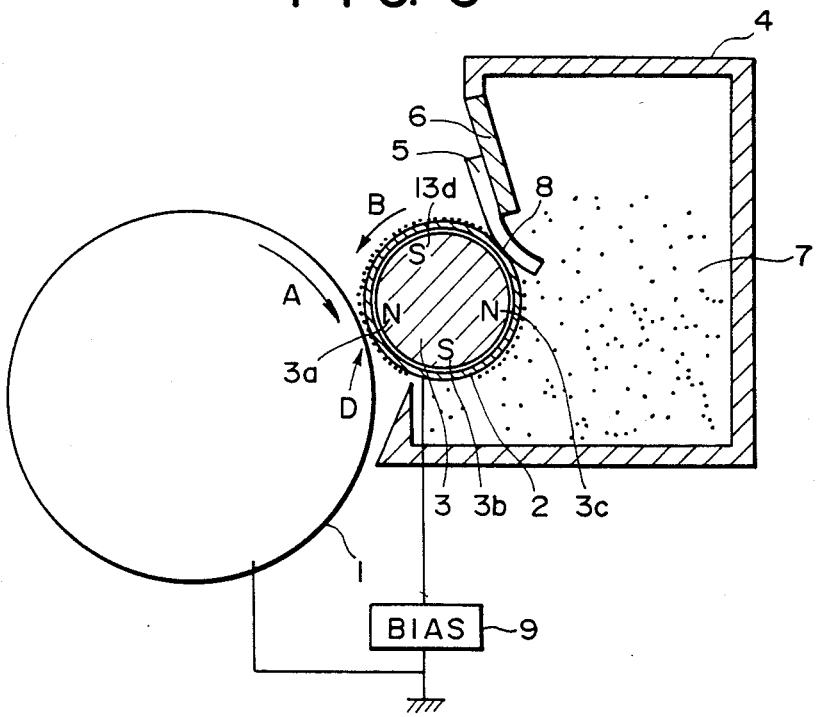
FIG. 6 is a sectional view of a developing apparatus according to a further embodiment of the present invention.

With this arrangement, the magnetic poles 3*a*' and 3*c*' function substantially as the magnetic poles 3*a* and 3*c*. However, the magnetic force by the magnetic pole 3*c*' at the contact portion 8 becomes relatively weak, and therefore, the developer is more strongly stirred in the direction d' in FIG. 5 due to the structure of the apparatus. Accordingly, the advantageous effects of the present invention are further enhanced. Even when the two pole magnet is used, the developer can be sufficiently conveyed when the outer diameter of the sleeve is 5–25 mm. In the foregoing embodiments, the regulating member 5 in the form of a plate is contacted to the sleeve 2 codirectionary with the rotational direction of the sleeve 2. However, as shown in FIG. 6, the regulating member 5 may be contacted thereto counterdirectionary to the rotational direction of the developing sleeve 2, with the above-described advantages.

The present invention is applicable to a developing apparatus not only for an electrophotographic copying apparatus but also for a laser beam printer or LED printer or the like. The present invention is also applicable to a reverse development apparatus wherein a light potential region of the latent image receives the toner, as well as an ordinary developing apparatus wherein the dark potential region of the latent image receives the toner.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image, comprising:

a rotatable cylindrical member for carrying a developer;

a stationary magnet disposed in said cylindrical member;

means for supplying the developer to said cylindrical member;

regulating means for regulating a thickness of a layer of the developer supplied to the cylindrical member, said regulating means including an elastic member contacted to said cylindrical member at a position between two adjacent magnetic poles;

wherein a magnetic force F (Gauss) of that magnetic pole of the two adjacent magnetic poles which is disposed upstream of a contact position between said elastic member and said cylindrical member with respect to a rotational direction of said cylindrical member and a contact pressure P (g/cm) between said elastic member and said cylindrical member satisfy $$0.71P+385[<=]\leqq F\leqq -1.43P+1630.$$

2. An apparatus according to claim 1, wherein the contact pressure P is not less than 20 g/cm and not more than 300 g/cm.

3. An apparatus according to claim 1 or 2, wherein the magnetic force F is not less than 400 Gausses.

4. An apparatus according to claim 3, wherein a magnetic force of the magnetic pole downstream of the contact position with respect to the rotational direction of said cylindrical member is not less than 400 Gausses and not more than 1200 Gausses.

5. An apparatus according to claim 4, wherein a distance $l_1$ (mm) between the contact position and the magnetic pole upstream of the contact position measured along an outer periphery of said cylindrical member and a distance $l_2$ (mm) between the contact position and the magnetic pole downstream of the contact position measured along the outer periphery of said cylindrical member, satisfy $$l_1 \geqq 2,\ l_2 \geqq 5,\ l_1 + l_2 \geqq 20.$$

6. An apparatus according to claim 1 or 2, wherein said magnet has only two magnetic poles adjacent an outer periphery of said magnet.

7. An apparatus according to claim 6, wherein said cylindrical member has a diameter not less than 5 mm and not more than 25 mm.

8. An apparatus according to claim 1 or 2 further comprising means for forming a vibratory electric field in a developing zone wherein said cylindrical member is opposed to a member bearing a latent image to be developed by said developing apparatus.

9. An apparatus according to claim 1, wherein said elastic member is in the form of a plate.

10. An apparatus according to claim 9, wherein said elastic member is of rubber.

11. An apparatus according to claim 2, wherein said elastic member is in the form of a plate.

12. An apparatus according to claim 11, wherein said elastic member is of rubber.

* * * * *

UNITED STATES PATENT AND TRADEMARK OFFICE

CERTIFICATE OF CORRECTION

PATENT NO. : 4,895,105

DATED : January 23, 1990

INVENTOR(S) : TAKAHIRO KUBO ET AL.

It is certified that error appears in the above-identified patent and that said Letters Patent is hereby corrected as shown below:

COLUMN 3

Line 21, "member. 5" should read --member 5--.
Line 31, "ble:" should read --ble.--.
Line 53, "B" should be deleted

COLUMN 4

Line 36, "of the developer" should be deleted.

Line 65, "is produced" should be deleted.

COLUMN 6

Line 59, "0.71P+385[<=]≦F≦-1.43P+1630." should read --0.71P+385≦F≦-1.43P+1630.--.

UNITED STATES PATENT AND TRADEMARK OFFICE

CERTIFICATE OF CORRECTION

PATENT NO. : 4,895,105

DATED : January 23, 1990

INVENTOR(S) : TAKAHIRO KUBO ET AL.

It is certified that error appears in the above-identified patent and that said Letters Patent is hereby corrected as shown below:

COLUMN 7

Line 13, "$l_1 \geq 2, l_2 \geq 5, l_1 + l_2 \geq 20$." should read --$\underline{l}_1 \geq 2$, $\underline{l}_2 \geq 5$, $\underline{l}_1 + \underline{l}_2 \leq 20$.--.

Signed and Sealed this

Fifteenth Day of September, 1992

*Attest:*

DOUGLAS B. COMER

*Attesting Officer*

*Acting Commissioner of Patents and Trademarks*